US007043935B2

(12) United States Patent
Hunter

(10) Patent No.: US 7,043,935 B2
(45) Date of Patent: May 16, 2006

(54) ENCLOSURE THERMAL SHIELD

(76) Inventor: Rick C. Hunter, 716 Pin Oak Dr., Friendswood, TX (US) 77546

( * ) Notice: Subject to any disclaimer, the term of this patent is extended or adjusted under 35 U.S.C. 154(b) by 130 days.

(21) Appl. No.: 10/336,170

(22) Filed: Jan. 3, 2003

(65) Prior Publication Data

US 2003/0126882 A1 Jul. 10, 2003

Related U.S. Application Data

(63) Continuation-in-part of application No. PCT/US01/21016, filed on Jul. 3, 2001, and a continuation-in-part of application No. 09/898,588, filed on Jul. 3, 2001, now abandoned.

(60) Provisional application No. 60/215,713, filed on Jul. 3, 2000.

(51) Int. Cl.
*F25D 3/08* (2006.01)

(52) U.S. Cl. ..... 62/457.2; 62/457.7

(58) Field of Classification Search ..... 62/457.2, 62/530, 457.6, 457.7, 371; 220/592.2, 592.26, 220/495.03
See application file for complete search history.

(56) References Cited

U.S. PATENT DOCUMENTS

| | | | | | |
|---|---|---|---|---|---|
| 1,478,770 | A | * | 12/1923 | Steel et al. | 217/128 |
| 1,864,040 | A | * | 6/1932 | Campbell | 62/388 |
| 1,998,681 | A | | 4/1935 | Littleford, Jr. | 62/91.5 |
| 3,387,650 | A | * | 6/1968 | Masshake et al. | 165/75 |
| 3,406,532 | A | * | 10/1968 | Bridges et al. | 62/457.2 |
| 3,605,431 | A | * | 9/1971 | Carson | 62/190 |
| 3,678,703 | A | * | 7/1972 | Cornish et al. | 62/371 |
| 4,425,917 | A | * | 1/1984 | Kuznetz | 607/110 |
| 4,958,506 | A | * | 9/1990 | Guilhem et al. | 62/457.2 |
| 5,544,495 | A | * | 8/1996 | Anderson et al. | 62/457.7 |
| 6,082,443 | A | * | 7/2000 | Yamamoto et al. | 165/104.26 |
| 6,145,333 | A | * | 11/2000 | Richmond et al. | 62/258 |

FOREIGN PATENT DOCUMENTS

| | | | |
|---|---|---|---|
| FR | 1226222 | | 7/1960 |
| GB | 2193301 | | 2/1988 |
| GB | 2193301 | A * | 2/1988 |

* cited by examiner

*Primary Examiner*—Chen Wen Jiang
(74) *Attorney, Agent, or Firm*—John R. Casperson

(57) ABSTRACT

An enclosure thermal shield (10) has a thermally insulated open container (12), a thermally insulated closure member (14), a thermally conductive liner (16) along the container's inner surface and along the inner surface of the closure member (14) forming a thermal circuit when the closure member (14) closes the container (12), and a heat reservoir (18) in thermal contact with the thermal circuit. The heat reservoir (18) can be placed within the container (12) or incorporated into the closure member (14). If incorporated into the closure member (14), the heat reservoir (18) can be placed in direct thermal contact with the thermal circuit or connected to the thermal circuit via a thermal conduit (28). The thermal shield (10) can further comprise a layer (26) of insulating material lining the interior surface of the conductive liner (16). Heat pipes can also be employed as a part of the thermal circuit.

2 Claims, 7 Drawing Sheets

ENCLOSURE THERMAL SHIELD

CROSS-REFERENCE TO RELATED APPLICATIONS

This application is a continuation-in-part of PCT/US01/21016 filed Jul. 3, 2001 and is a continuation-in-part of Ser. No. 09/898,588 filed Jul. 3, 2001, now abandoned, which claims benefit of 60/215,713 filed Jul. 3, 2000.

BACKGROUND OF THE INVENTION

1. Field of the Invention

This invention relates to a thermally insulated container. In certain aspects, the invention relates to a thermally insulated container having a thermal shield designed to conduct thermal energy to or from a heat reservoir to maintain more uniform temperature within the container.

2. Description of the Prior Art

Prior insulated containers rely on the thermal resistivity of the material comprising the container and convection currents and a heat reservoir within the container chamber to maintain a desired thermal environment within the container. A typical prior art container designed to maintain cool temperatures is a polystyrene plastic box with ice or a frozen gelpack inside the box's payload region. A significant problem with this approach is the heat flux through the box walls. Depending on the thermal resistivity of the insulation and the ambient temperature outside the box, the heat leak into the box can be significant. The resulting heat load must be convectively carried to the heat reservoir to maintain constant temperature within the box.

Note a similar problem exists in reverse if a hot product is the payload and a heat source such as a hot brick is the heat reservoir. Everything stated below will be limited to the cold payload situation, but not all embodiments of the invention are so limited.

Prior art insulated containers have proved unsuitable for products that require tight temperature tolerances. Excessive heat gain can exhaust the heat reservoir, causing the temperature to rise rapidly with additional heat gain. Temperature variation can exceed tolerances because the heat reservoir may absorb too much heat from the product itself, lowering its temperature to an unacceptable level. The temperature gradient within the payload volume may be unacceptably large because the warmer air that accumulates near the top of the container is somewhat removed from the colder air surrounding the heat reservoir. Depending on the extent of temperature gradient, a payload could conceivably be too cold at the lower end and too warm on the upper end.

SUMMARY OF THE INVENTION

In one embodiment, the present invention uses an innovative design to produce an enclosure thermal shield having a thermally insulated open container, a thermally insulated closure member, a thermally conductive liner along the container's inner surface and along the inner surface of the closure member that forms a thermal circuit when the closure member closes the container, and a heat reservoir in thermal contact with the thermal circuit. The heat reservoir can be placed within the container or incorporated into the closure member. If incorporated into the closure member, the heat reservoir can be placed in direct thermal contact with the thermal circuit or connected to the thermal circuit via a thermal conduit. The thermal shield can further comprise a layer of insulating material lining the interior surface of the conductive liner to further inhibit heat transfer into or out of the interior chamber of the container. The thermal shield and method for directing heat flow regulate the thermal environment of the chamber.

Another embodiment of the invention employs heat pipes to conduct heat from one area to another. In the most basic application, heat pipe devices are used to move heat or thermal energy that enters the container through the walls of an enclosure towards the heat sink, refrigerant or otherwise the cooling source of the enclosure. This thermal energy is captured by the thermal shield, incorporating the heat pipe device, and redirects the energy away from the payload compartment. The use of heat pipes in the present invention is a significant improvement over containers that utilize solid conductors to move heat both in terms of reduced mass and increased heat transfer rates. Furthermore, the heat pipe thermal shield requires no energy to operate and does not rely on fans and fan controllers to move heat within a container. Heat pipes can have effective heat transfer rates many times higher than copper or any other solid material enabling tighter temperature control within the enclosure.

DETAILED DESCRIPTION OF THE INVENTION

Figure 1:
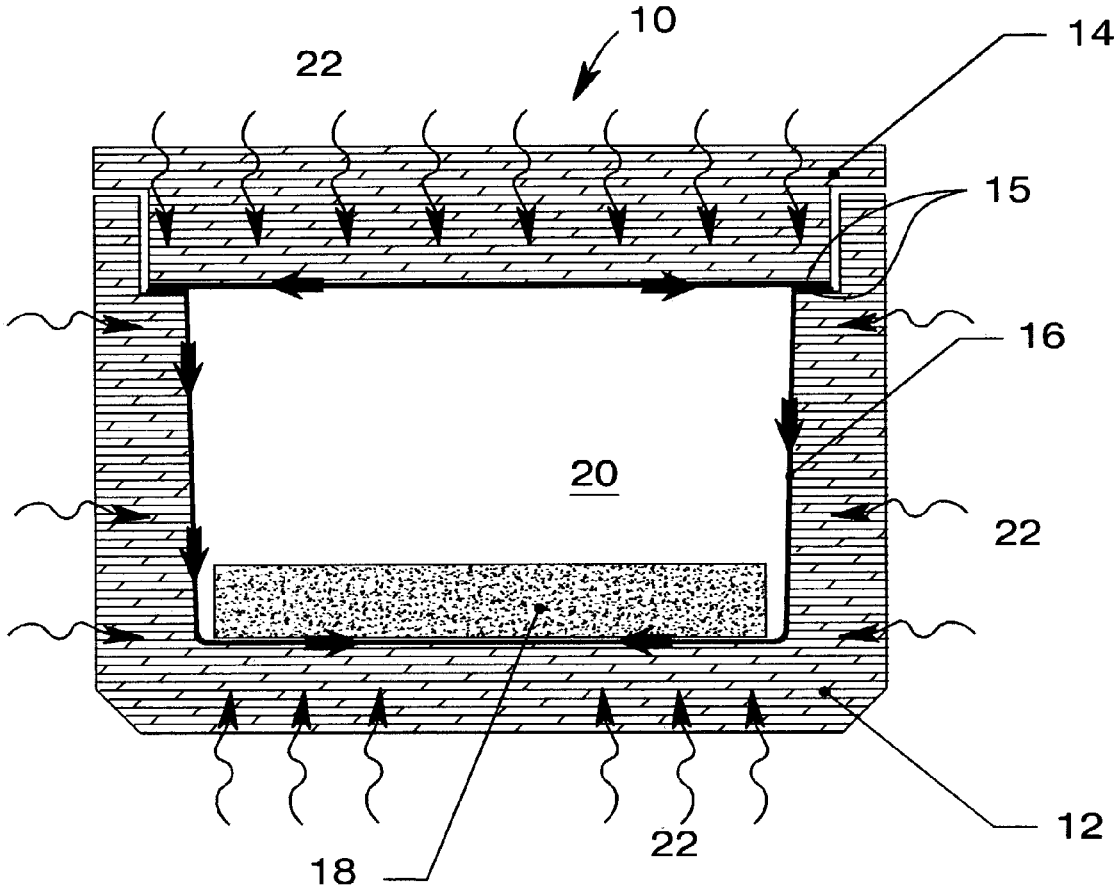
FIG. 1 is a cross section of an elevation view of a first embodiment of an enclosure thermal shield constructed in accordance with one embodiment of the present invention.

Referring to FIG. 1, enclosure thermal shield 10 comprises an open container 12 and closure member 14, both of which are constructed using a highly thermally resistive material such as polystyrene plastic or vacuum insulation panels. Thermally conductive liner 16 lines the interior surface of container 12 and the lower surface of closure member 14. Container 12 and closure member 14 each have a shoulder 15 which abut when closure member 14 closes container 12.

Closure member 14 fits snugly in container 12 to form an airtight seal and, when shoulders 15 are in abutting contact, thermally conductive liner 16 is also in abutting contact to complete a thermal circuit for conductive liner 16. Heat reservoir 18 is placed in container 12 in thermal contact with liner 16.

As stated above, heat reservoir 18 can be hot or cold, depending on the application. An ideal heat reservoir remains at a constant temperature independent of the amount of heat put onto or withdrawn from it. Thus, a heat reservoir is useful as a thermostatic device because it will maintain a constant temperature for the environment in thermal contact with it. Heat reservoir 18 approximates an ideal heat reservoir, but actually is more like a heat sink or source in the sense it generally either absorbs or delivers heat, depending on the application. We choose the term "heat reservoir" because the thermal mass of the material being used as a heat reservoir will generally be large relative to the anticipated heat load, such that the temperature of the heat reservoir will not change appreciably during its expected period of use. "Heat reservoir" also conveys the idea that it can absorb or deliver heat, although as a practical matter it generally is intended to do one or the other. For ease of discussion, the description below shall be limited to the cold temperature/heat sink scenario.

In such a situation, it is anticipated that the enclosure thermal shield 10 will be placed in an ambient environment that is warmer than the desired temperature of a payload. Thus, there will be a net flux of heat toward the container's interior chamber 20.

Ordinarily, heat 22 (represented by squiggly arrows in figures) would pass through the thermally resistive material comprising container 12 and closure member 14. Without conductive liner 16, heat 22 would enter chamber 20. However, conductive liner 16 absorbs heat 22 and directs it to heat reservoir 18. Heat reservoir 18 absorbs the infiltrated heat 22 and traps it within the reservoir 18. Thus, the infiltrated heat 22 is intercepted and transported away from the container's interior chamber.

The embodiment of FIG. 1 relies on convection to minimize the thermal gradient in chamber 20. While the vast majority of heat 22 will be conducted into heat reservoir 18, it is possible that some of heat 22 will radiate or conduct from conductive liner 16 and enter chamber 20 as heat 24 (represented by small squiggly arrows in FIGS. 2 and 3). The embodiments of FIGS. 2 and 3 add insulation layer 26 onto the interior surface of conductive liner 16. Insulation layer 26 reduces heat transfer from liner 16 into chamber 20. Thus, very nearly all of infiltrated heat 22 is conducted into heat reservoir 18, minimizing the amount of heat 24 that actually enters chamber 20.

Figure 2:
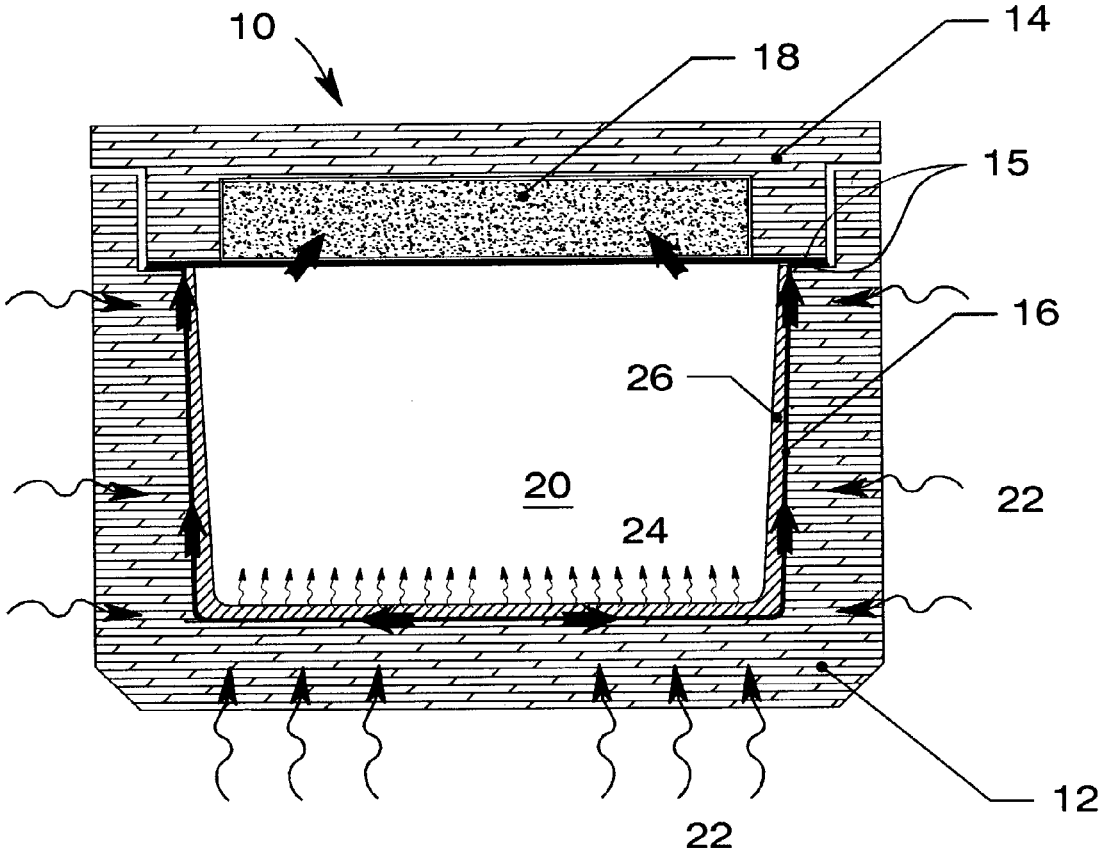
FIG. 2 is a cross section of an elevation view of another embodiment of an enclosure thermal shield constructed in accordance with the present invention.
Figure 3:
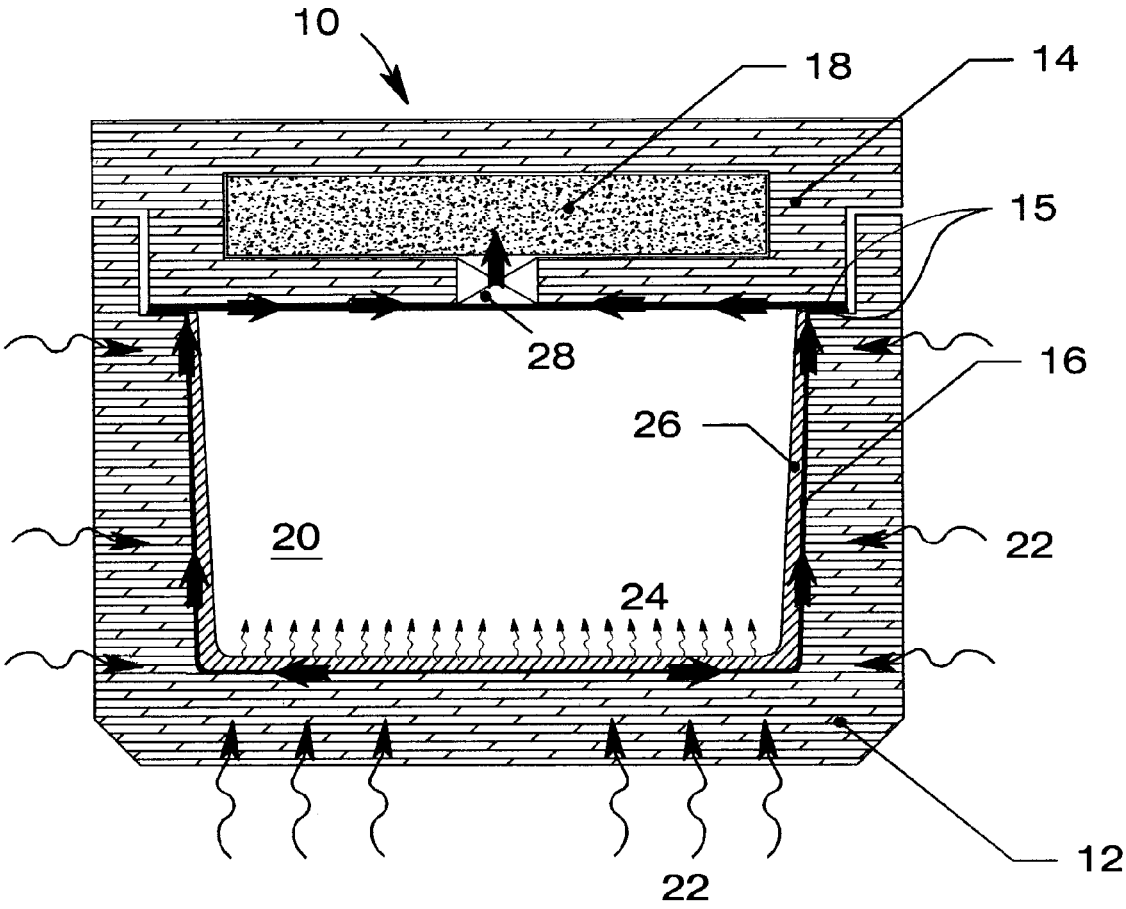
FIG. 3 is a cross section of an elevation view of another embodiment of an enclosure thermal shield constructed in accordance with the present invention.

FIGS. 2 and 3 show heat reservoir 18 in closure member 14 instead of within chamber 20 as was done in the embodiment of FIG. 1. In FIG. 2, heat reservoir 18 is placed in direct thermal contact with the outer surface of liner 16. Placing heat reservoir 18 in closure member 14 allows for greater payload capacity and allows one to chill heat reservoir 18 and closure member 14 as a unit in anticipation of enclosure thermal shield's 10 next application. Having heat reservoir 18 on top also increases the convection efficiency when used to cool chamber 20 and minimizes the temperature gradient within chamber 20.

In FIG. 3, heat reservoir 18 is within closure member 14, but separated from liner 16 by the insulation material of closure member 14. Heat reservoir 18 is thermally linked to liner 16 by thermal conduit 28. Conduit 28 allows one to control the rate of heat transfer into heat reservoir 18. For example, conduit 28 can be a thermal conductor sized according to expected heat loads and the desired temperature range within chamber 20 to regulate heat transfer. Thermal conduit 28 can also comprise a thermally resistive material. Additional alternative embodiments for conduit 28 include an air passage, a material that switches state, a thermoelectric device, or a thermal switch.

The present invention offers many advantages over the prior art. The temperature gradient within a container using the thermal shield varies less than in prior art containers. By placing less demand on convection for heat transfer, the temperature within the container is better regulated. Using a thermal conduit allows use of a subcooled heat reservoir without risk of excess heat transfer, thus precluding the possibility of a product being destroyed as a result of excess chilling.

The enclosure thermal shield protects a payload product that must be maintained within a certain temperature range, for example, in the range of from 2 to 8 degrees C. Examples of such products include vaccines and cancer fighting drugs. The outer insulation material is made from thermal insulators such as polyurethane foam or vacuum insulation panels, to minimize the amount of heat that enters the container. The thermally conductive liner collects some of the thermal energy that penetrates the insulation and redirects this heat to the heat reservoir, thereby preventing this portion of the incoming thermal energy from passing through the payload compartment where the payload product is stored. The amount of thermal energy redirected into the heat reservoir is a function of the thermal liner's thermal transport capability. In a passive thermal liner made from aluminum or copper sheet, the heat transport capability is a function of the material's thermal conductivity measured in W/m-K (watts per meter degree Kelvin) and the material's thickness measured in meters. The actual amount of heat energy redirected is a function of the operating temperatures, the width of the shield, and the distance from the heat reservoir when the thermal energy enters the shield. In an active thermal liner such as a heat pipe, the thermal transport capability is primarily a function of the working fluid's thermal conductivity, heat of vaporization, and liquid phase transport velocity. The amount of thermal energy that can be redirected to the heat reservoir can be increased by increasing the thermal resistance of heat flow into the payload area by adding an inner layer or insulating material such as polyurethane foam or vacuum insulation panels. This inner layer of insulation resides between the payload and the thermal liner.

For the enclosure thermal shield to be most effective, the outer insulation should have a thermal conductivity of 0.08 W/m-K or less, and a thickness of 0.006 meters or greater. As expressed in terms of "R" values, the outer insulation should have an "R" value of at least R 1.8 (hr-ft2-F/BTU-in). The upper limit to the thickness of the outer insulation is driven most by practical considerations, and will generally be 0.2 meters or less. In a preferred embodiment, the layer of highly thermally insulating material in the walls of the container member will have an R value of at least 20 per inch. The thermal liner material should have a thermal conductivity greater than 50 W/m-K and a thickness of 0.0013 meters or greater. Highly heat conductive metals are suitable, for example, aluminum, copper or gold. These liner materials will usually be in sheet form and have a thickness in the range of 0.0001 to 0.01 meters. The inner insulation layer, when employed, should have a thermal conductivity of 0.08 W/m-K or less and a thickness of 0.003 meters or greater, up to a practical upper thickness limit of about 0.03 meters.

Another embodiment of the invention employs heat pipes to conduct heat from one area to another. Heat pipes are enclosed containers filled with a working fluid that transfers heat through the heating and cooling of the fluid inside. In most instances, this requires a phase change from liquid to gas as heat enters the heat pipe at one end (or edge) and rejects the heat into a heat sink at the other end (or edge) of the heat pipe. There are numerous variations to the standard heat pipe and each may have advantages in the current invention. Such variations include thermosyphons which generally do not require a wick to return the liquefied fluid back to the heat source and generally rely on gravity, Dinh or loop heat pipes which have a separate passage for the liquid and gas phases respectively, vapor chambers or flat heat pipes which have a sealed chamber typically flat in geometry that spreads heat over a large area. For the purposes here, the above types of heat pipes are referred to as heat pipe devices.

There are a number of commercial suppliers of heat pipes including Thermacore, Inc. and Noren Products Inc. in the US, Fujikura America Inc. and Atherm in France. A wide range of fluids are used in heat pipes including, but not limited to, ammonia, water, alcohol, methanol, ethanol, propane, butane, hexane, methane, and various other hydrocarbon compounds and mixtures, oxygen, nitrogen, helium and carbon dioxide. The selection of fluids depends on the temperature range over which heat is to be transferred and its compatibility with the structure and materials of the heat pipe design.

The heat sink will generally comprise a mass of a phase change material. For example, a suitable heat sink can be selected from the group consisting of dry ice, liquid nitrogen, and an aqueous salt solution. The heat sink can also comprise an active refrigeration system, if desired. For example, the active refrigeration system can be selected from the group consisting of vapor compression, thermoelectric, Stirling cycle, Brayton cycle, and magnetic active refrigeration systems.

Figure 4:
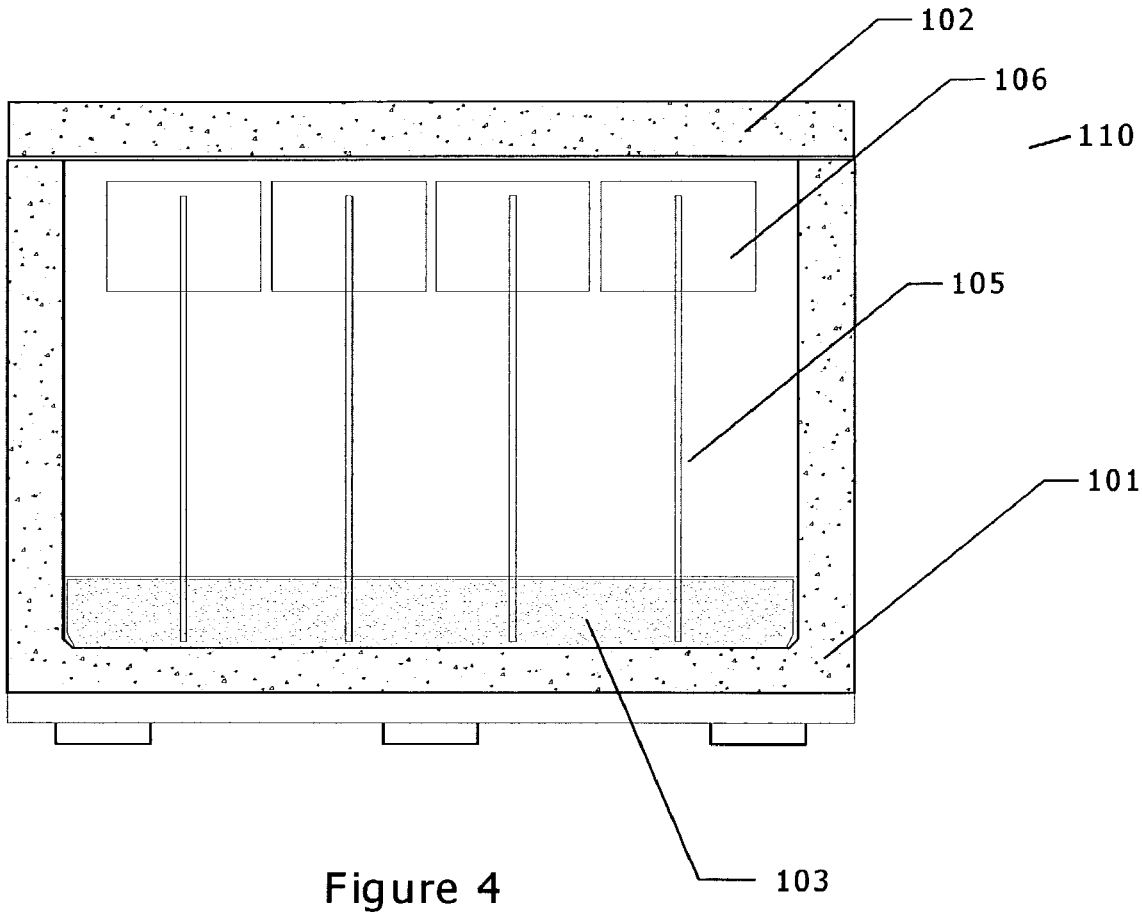
FIG. 4 is a cross section of an elevation view of another embodiment of the invention which employs heat pipes.

In FIG. 4, a thermal enclosure 110 is comprised of an insulated body 101 having an insulated lid or door opening 102. A refrigerant or heat sink 103 is used as the heat sink or means to keep the product inside refrigerated or frozen. There exist one or more heat pipes 105 in conjunction with heat collectors 106 covering some or all of the internal surface area of the enclosure. The condensing end of the heat pipes 105 are thermally connected to the heat sink 103. The heat pipes are best thermally connected to the heat sink 103 through the use of a flat conductive plate, such as aluminum or a flat heat pipe. The evaporative end of the heat pipes 105 extend away from the heat sink to the sides and ideally upper portion of the enclosure, since heat energy rises by convection to the top of the enclosure. Here, the heat pipes are thermally connected to heat collectors or spreaders 106 such as a flat sheet of aluminum or a flat heat pipe. Furthermore, the ends of the heat pipes may be connected to an air type heat exchanger where air movement is used to better distribute and collect heat from within the container.

Figure 5:
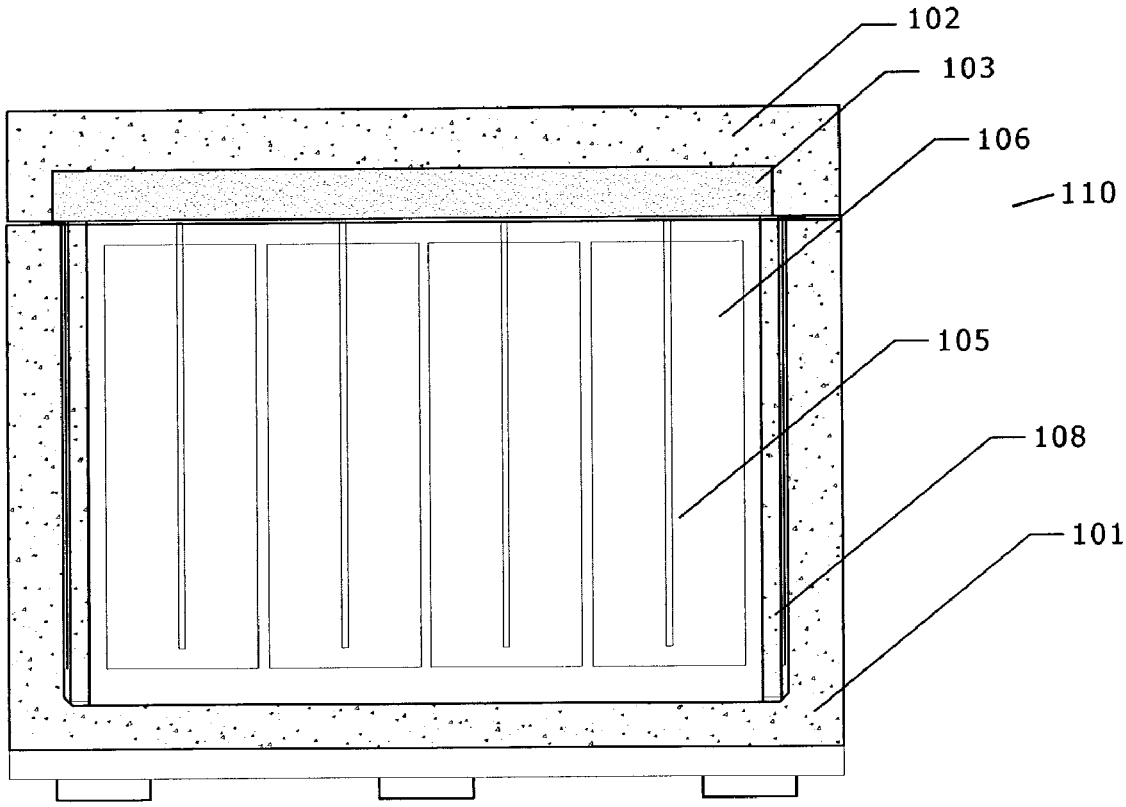
FIG. 5 is a cross section of an elevation view of another embodiment of the invention which employs heat pipes and has the heat sink in the lid.

FIG. 5 illustrates an enclosure with the refrigerant or heat sink 103 located in the lid of the container. In this configuration it is important to protect the lower portion of the enclosure from thermal energy entering into to the lower part of the enclosure. Hence heat pipe devices 105 and heat collectors 106 are used to comprise the thermal shield covering all or part of the lower part of the container 101. The refrigerant in the lid 102 of enclosure 110 may or may not be thermally coupled to the body 101 of the enclosure. If coupled, the thermal connection can be accomplished through a variety of means including but not limited to heat sensitive thermal actuators, electromechanical devices controlled by a microprocessor, a diode heat pipe (a heat pipe that conducts heat in only one direction), a mechanical interface incorporating conducting metals, conductive polymers, conductive greases, fiber and brush type interfaces, and a fan heat transfer means. It is further advantageous that the inside surface of the body 101 be fitted with a thermal insulator 108 such as polystyrene foam or with vacuum insulation panels. While FIG. 5 is a cross sectional view of the enclosure, the inside insulation is removed from the back wall in order to see the orientation of the heat pipes 105 and heat collectors 106. This added insulation further inhibits thermal energy from entering into the payload compartment. It should be understood that the lid 102 of said enclosure 110 may also incorporate heat pipes and heat plates and lid 102 may or may not be thermally connected to the body 101 of the enclosure 110.

Figure 6:
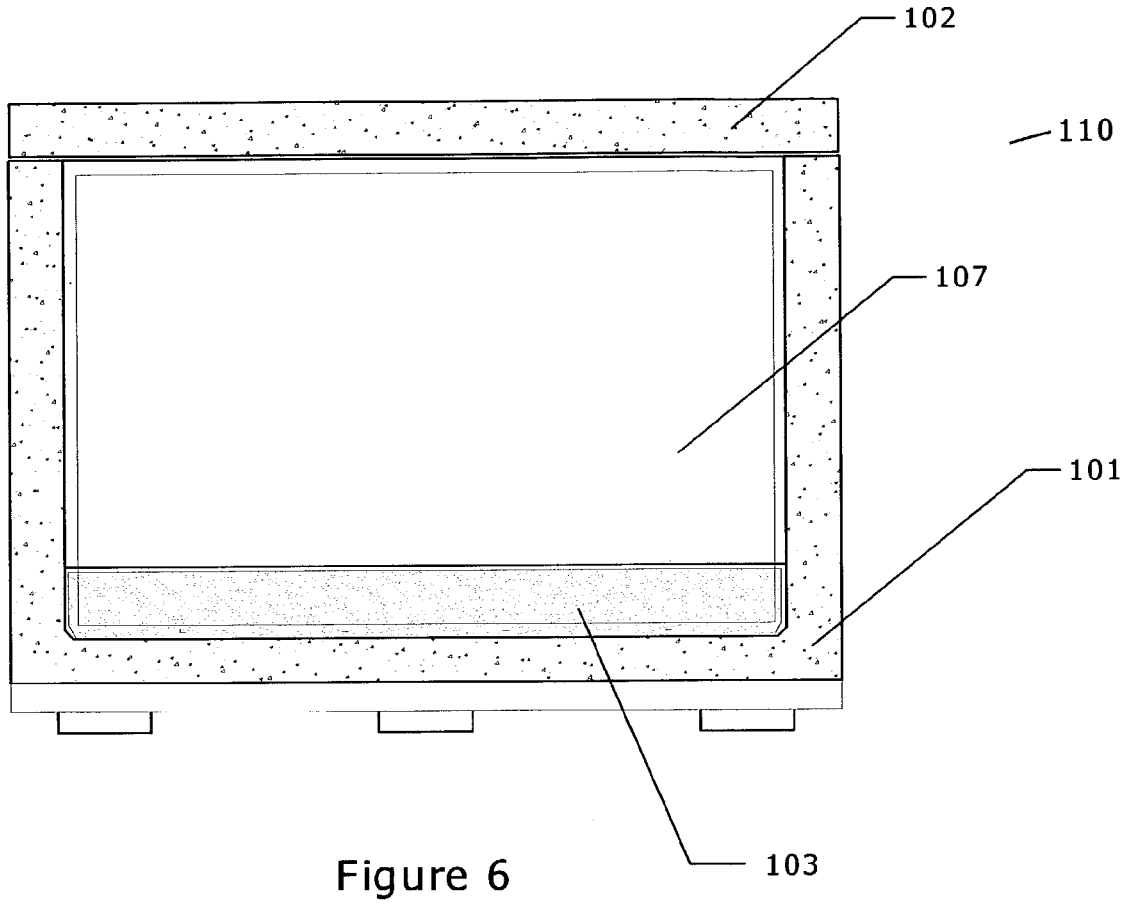
FIG. 6 is a cross section of an elevation view of another embodiment of the invention in which a flat heat pipe is employed.

FIG. 6 illustrates an insulated enclosure 110 having a heat sink 103. In this embodiment, the heat sink is thermally connected to the walls of the enclosure 101 through a flat heat pipe 107. Said flat heat pipe is a flat chamber incorporating a working fluid such that heat is moved from the heat pipe thermal shield to the heat sink 103.

Figure 7:
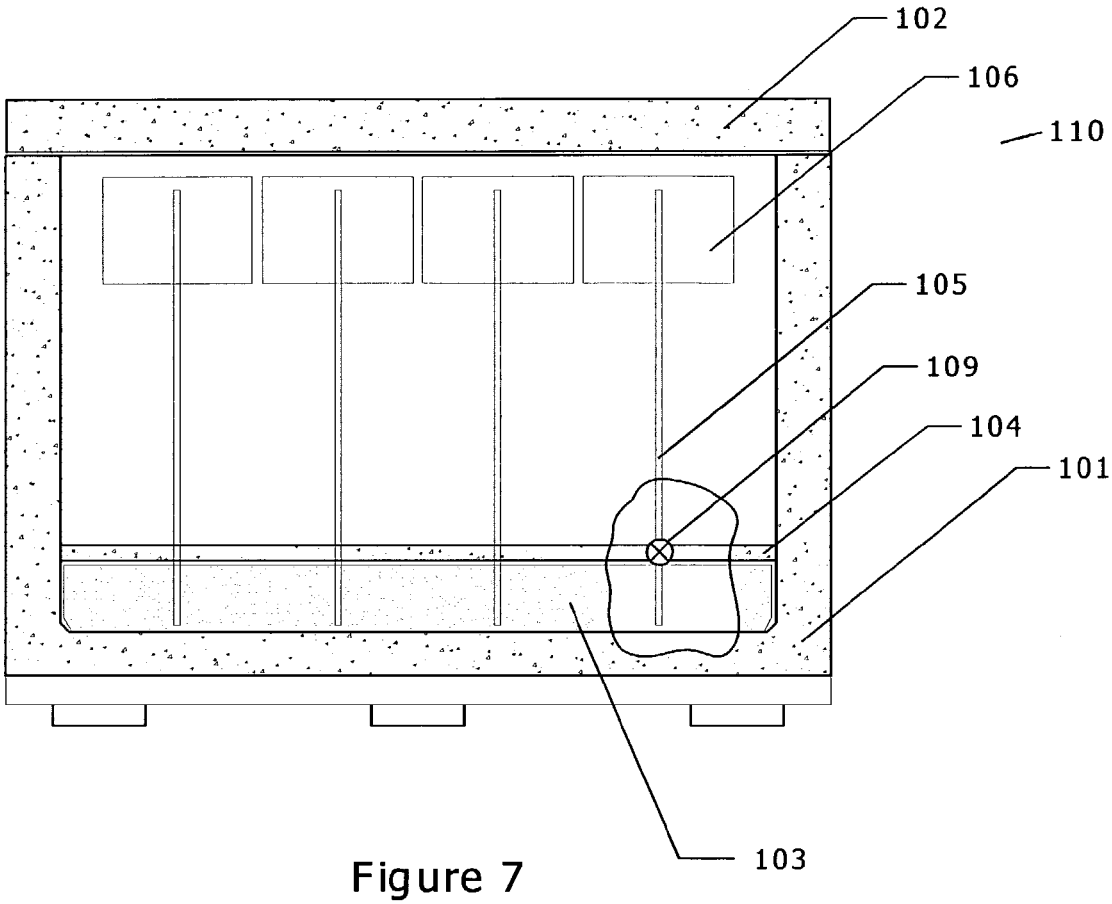
FIG. 7 is a cross section of an elevation view of another embodiment of the invention, partly schematic, where a thermal disconnect is incorporated in the heat pipe system.

FIG. 7 illustrates another embodiment of the present invention where a thermal disconnect 109 is incorporated in the heat pipe system 105 with heat collectors 106 between the heat sink and the enclosure. This thermal disconnect can be accomplished through a variety of means including but not limited to heat sensitive thermal actuators, electromechanical devices controlled by a microprocessor or thermal switch, a diode heat pipe (a heat pipe that conducts heat in only one direction), a heat pipe, a mechanical interface incorporating conducting metals, conductive polymers, conductive greases, fiber and brush type interfaces, and a fan heat transfer means. The purpose of said thermal disconnect is to regulate the flow of energy into the payload space of the enclosure to achieve a certain temperature environment. Hence the heat sink or refrigerant 103 may be at a significantly lower temperature than the desired temperature of the payload.

Also shown in FIG. 7 is an optional thermal barrier 104 that minimizes the heat transfer into the heat sink 103. It is advantageous to limit such heat transfer in order to achieve better temperature control.

This discussion is presented as though the container is in an environment of a temperature greater then the desired storage or transport temperature. It should be understood that this invention similarly relates to enclosures that may be in an environment that is colder outside than the desired storage or payload temperature, where said heat sink is a heat source and energy through such heat pipe arrangements is in the reverse order as those described above. Furthermore, it is envisioned that the current invention may incorporate both a heat sink and a heat source, which may or may not be thermally isolated from each other or the payload compartment. Such an arrangement is beneficial where external environments are unpredictable and may be hotter or colder than the desired payload temperature.

While certain preferred embodiments of the invention have been described herein, the invention is not to be construed as being so limited, except to the extent that such limitations are found in the claims.

What is claimed is:

1. An enclosure thermal shield comprising:

an open container defining a payload chamber surrounded by walls formed of a highly thermally insulating material;

a closure member having a layer of a highly thermally insulating material for opening and closing the container;

a first highly thermally conducting layer lining an interior surface of the walls of the container;

a second highly thermally conducting layer lining an interior surface of the closure member, the first highly thermally conducting layer being in thermal contact with the second highly thermally conducting layer to form a thermal circuit when the closure member closes the container;

a layer of thermal insulation material lining an interior surface of the first highly thermally conducting layer, said layer of thermal insulation material having a thermal conductivity of 0.08 W/m-K or less and a thickness of at least 0.003 meters; and a heat reservoir in thermal contact with the thermal circuit, wherein the heat reservoir is recessed in the closure member and is separated from the payload chamber.

2. Apparatus as in claim 1 wherein the heat reservoir is in contact with an outer surface of the second highly thermally conducting layer.

* * * * *